US008002256B2

(12) United States Patent
Sasahara

(10) Patent No.: US 8,002,256 B2
(45) Date of Patent: Aug. 23, 2011

(54) SHEET PROCESSING APPARATUS AND SHEET PROCESSING METHOD

(75) Inventor: Katsuya Sasahara, Shizuoka-ken (JP)

(73) Assignees: Kabushiki Kaisha Toshiba, Tokyo (JP); Toshiba Tec Kabushiki Kaisha, Tokyo (JP)

( * ) Notice: Subject to any disclaimer, the term of this patent is extended or adjusted under 35 U.S.C. 154(b) by 386 days.

(21) Appl. No.: 12/173,637

(22) Filed: Jul. 15, 2008

(65) Prior Publication Data

US 2009/0026687 A1 Jan. 29, 2009

(30) Foreign Application Priority Data

Jul. 24, 2007 (JP) ..... P2007-191968

(51) Int. Cl.
*B65H 37/04* (2006.01)
*B31F 1/10* (2006.01)

(52) U.S. Cl. ..... 270/45; 270/20.1; 270/32; 270/37; 270/58.07; 493/444; 493/445

(58) Field of Classification Search ..... 270/20.1, 270/32, 37, 39.01, 39.08, 45, 58.07; 493/415, 493/424, 427, 431, 434, 435, 442, 444, 445
See application file for complete search history.

(56) References Cited

U.S. PATENT DOCUMENTS 3,616,069 A * 10/1971 Schwalbach ..... 156/444
4,419,088 A * 12/1983 Nemec ..... 493/444
4,643,705 A * 2/1987 Bober ..... 493/444
6,042,529 A * 3/2000 Hubler et al. ..... 493/434
7,537,556 B2 * 5/2009 Bober ..... 493/23
7,537,558 B2 * 5/2009 Vono et al. ..... 493/443
2009/0005229 A1 * 1/2009 Vono et al. ..... 493/424

FOREIGN PATENT DOCUMENTS

JP 2003-63736 3/2003
JP 2005-8337 1/2005
JP 2005-89100 4/2005
JP 2005-306585 11/2005

OTHER PUBLICATIONS

U.S. Appl. No. 12/042,475.

* cited by examiner

*Primary Examiner* — Leslie A Nicholson, III
(74) *Attorney, Agent, or Firm* — Patterson & Sheridan, LLP

(57) ABSTRACT

A sheet processing apparatus includes a first roller, a second roller configured to press the first roller to form a nip portion, a moving member opposite to the nip portion to move from a start position to an operation position approaching the nip portion, a pushing member supported on the moving member to press a sheet by an end thereof by movement of the moving member and push the sheet into the nip portion, and a third and fourth rollers positioned on both sides of the pushing member and supported on the moving member.

19 Claims, 9 Drawing Sheets

SHEET PROCESSING APPARATUS AND SHEET PROCESSING METHOD

CROSS-REFERENCE TO RELATED APPLICATION

This application is based upon and claims the benefit of priority from the prior Japanese Patent Application No. 2007-191968, filed on Jul. 24, 2007; the entire contents of all of which are incorporated herein by reference.

FIELD OF THE INVENTION

The present invention relates to a sheet processing apparatus and a sheet processing method.

DESCRIPTION OF THE BACKGROUND

For example, Japanese Patent Application Publication No. 2005-89100 discloses an image forming apparatus including a sheet processing apparatus. The image forming apparatus includes a saddle stitching apparatus such as a stapler for sequentially fetching sheets with an image formed by the main body of the image forming apparatus and then stitching the neighborhood of the center of the sheets and a sheet processing apparatus for folding the stitched sheet bundle.

Japanese Patent Application Publication No. 2005-89100 discloses a sheet processing apparatus including a projected plate to project the central part of a sheet bundle and permit it to be held by a pair of rollers and a pair of rollers for folding the held sheet bundle in two.

The sheet bundle which is discharged from the main body of the image forming apparatus and is subjected to the saddle stitching process at the central part by the saddle stitching apparatus is conveyed into the sheet processing apparatus. Here, the sheet bundle is conveyed between the folding roller pair and the projected plate and is arranged so that the central part (the bound part) of the sheet bundle comes to the position facing the projected plate.

The paired folding rollers are driven to rotate in a predetermined direction and hold and crease the sheet bundle, so that a nip portion having a nip pressure due to pressurizing the contact portion of both rollers is formed.

The projected plate is controlled so as to make a reciprocating motion of moving from the start position to the operation position where the end thereof approaches the nip portion and then returning to its original start position.

The sheet bundle the central part of which is pressed by the projected plate makes contact with the paired folding rollers and is conveyed to the neighborhood of the nip portion by the friction with the contact surface. And, the sheet bundle is folded in two by the nip portion and is subject to the folding process. The sheet bundle which is folded and bound is sequentially discharged onto the bundled sheets receiving tray for receiving sheet bundles.

However, the constitution of Japanese Patent Application Publication No. 2005-89100 aforementioned is effective in a sheet bundle subjected to the saddle stitching process, though in a sheet bundle not subjected to the saddle stitching process, the sheets are not fixed mutually, so that sheets subjected to the folding process in the state that the ends thereof are not trued up may be generated.

For example, a sheet bundle composed of three sheets, in the situation before held by the paired folding rollers, is composed of a first sheet, a second sheet, and a third sheet from the side opposite to the paired folding rollers. Namely, the third sheet is opposite to the end of the projected plate and the saddle stitching process is not performed.

The sheet bundle pressed by the projected plate makes contact with the paired folding rollers and is conveyed to the neighborhood of the nip portion by the friction with the contact surface. In this period, there is no connection such as a binding process mark on the surface of the third sheet in direct contact with the projected plate and the frictional force is reduced due to a small contact surface between the projected plate and the third sheet, so that the third sheet slides down by its own weight, and the end of the projected plate is shifted and pressed from the central part of the third sheet and is held by the nip portion. By doing this, the end portion of the sheet bundle is shifted.

The adhesion between the first, second, and third sheets of the sheet bundle, since the saddle stitching process is not performed, depends on the friction with the contact surface of each sheet. When conveying the sheet bundle pressed to the neighborhood of the nip portion by the projected plate to the nip portion, the rotational power of the paired folding rollers firstly conveys the first sheet in direct contact with the paired folding rollers due to the friction with the contact surface. And, the second sheet and third sheet are similarly conveyed due to the friction with the contact surface with the first sheet conveyed. Here, the friction between the respective sheets is not ensured sufficiently, so that the second sheet is delayed from the first sheet and enters the nip portion. By doing this, the end portion of the sheet bundle is shifted.

As mentioned above, a problem arises that the end portion of the sheet bundle after the folding process becomes uneven, and the alignment is impaired, and defective binding is caused.

Further, as the surface of surface coated paper becomes smoother, the friction coefficient is reduced, so that the frictional force is lowered. Further, as the contact surface between the respective sheets is reduced, the surface for realizing the frictional force is not ensured, so that the frictional force is lowered.

SUMMARY OF THE INVENTION

In an embodiment of the present invention, there is provided a sheet processing apparatus comprising a first roller; a second roller configured to press the first roller to form a nip portion; a moving member opposite to the nip portion to move from a start position to an operation position approaching the nip portion; a pushing member supported on the moving member to press a sheet by an end thereof by movement of the moving member and push the sheet into the nip portion; and a third and fourth rollers positioned on both sides of the pushing member and supported on the moving member.

Furthermore, in an embodiment of the present invention, there is provided a sheet processing method comprising arranging a sheet between a first roller and a second roller having a nip portion and a pushing member; permitting a moving member for holding one end of the pushing member to move to an operation position where the other end of the pushing member approaches the first roller and the second roller; permitting third and fourth rollers supported on both sides of the pushing member to make contact with the sheet; permitting the third and fourth rollers to press the sheet against the first and second rollers; and permitting the other end of the pushing member to press a central part of the sheets and push the sheets into the nip portion.

DETAILED DESCRIPTION OF THE INVENTION

First Embodiment

Figure 1:
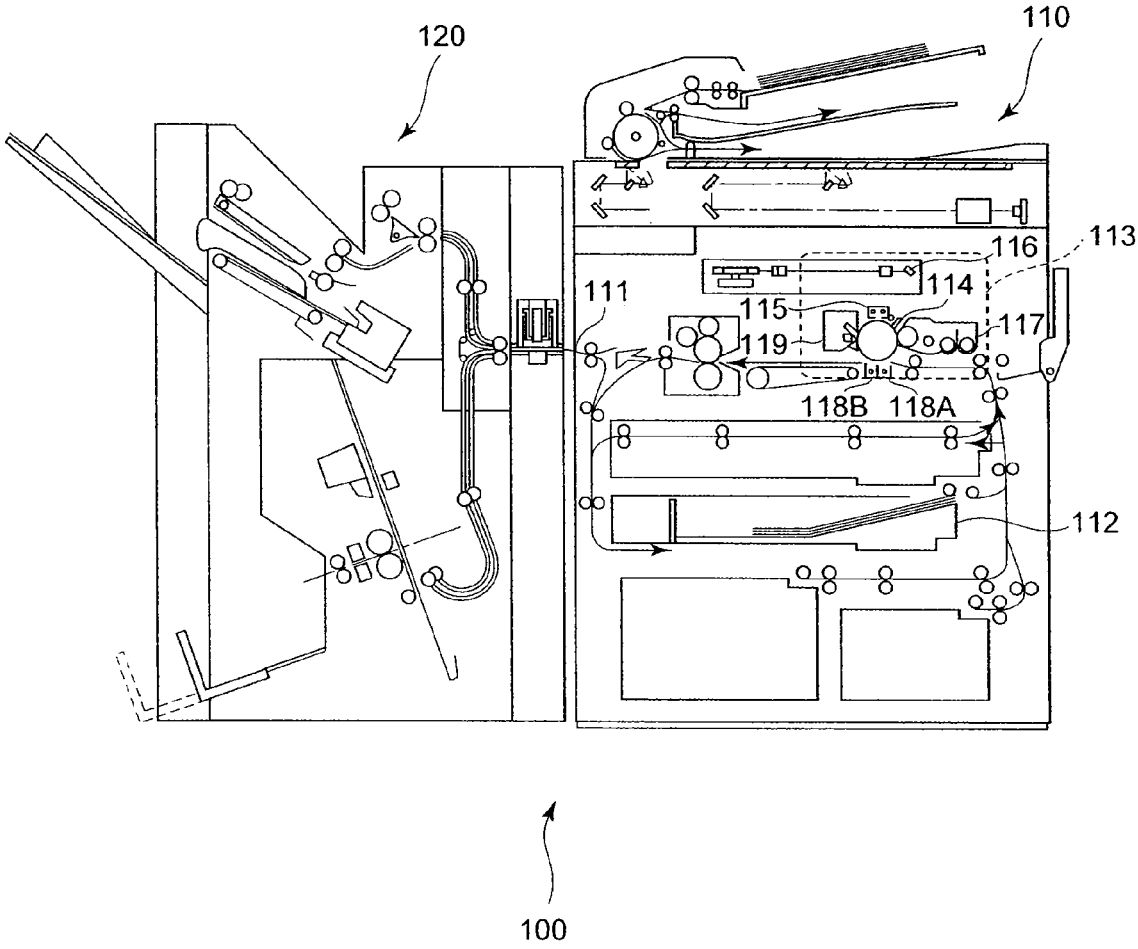
FIG. 1 is a cross sectional view showing the schematic constitution of the image forming apparatus relating to the first embodiment.

Hereinafter, the first embodiment will be explained with reference to FIGS. 1 to 7. FIG. 1 is a cross sectional view showing the schematic constitution of the image forming apparatus having a sheet processing apparatus relating to the first embodiment. A main body 110 of the image forming apparatus form monochromatic images and color images on sheets. The main body 100 of the image forming apparatus connects to a sheet finishing apparatus 120. The main body 110 of the image forming apparatus forms a monochromatic image and a color image forms on sheets includes a sheet storage portion 112 for storing sheets and an image forming portion 113 for forming an image on sheets. The image forming portion 113 includes a rotary transfer drum portion 114 and around it, a charging portion 115, an image exposing portion 116, a developing portion 117, an image transferring portion 118A, a charge eliminating portion 118B, and a cleaning portion 119. The surface of the transfer drum portion 114 is charged by the charging portion 115, and then exposure scanning is performed by a laser of the image exposing portion 116, and reverse development is performed by the developing portion 117, thus a toner image is formed on the surface of the transfer drum portion 114.

The image transferring portion 118A transfers the aforementioned toner image to a sheet fed from the sheet storage portion 112 at the transfer position of the image forming portion 113. The charge eliminating portion 118B eliminates the charge of the sheet. A sheet ejection portion 111 ejects the charge-eliminated sheet. The sheet ejected from the sheet ejection portion 111 is carried into the sheet finishing apparatus 120.

After the aforementioned image forming process, the cleaning portion 119 removes a developer remaining on the surface of the transfer drum portion 114. By doing this, the image forming portion 113 is ready for the next image forming process.

Figure 2:
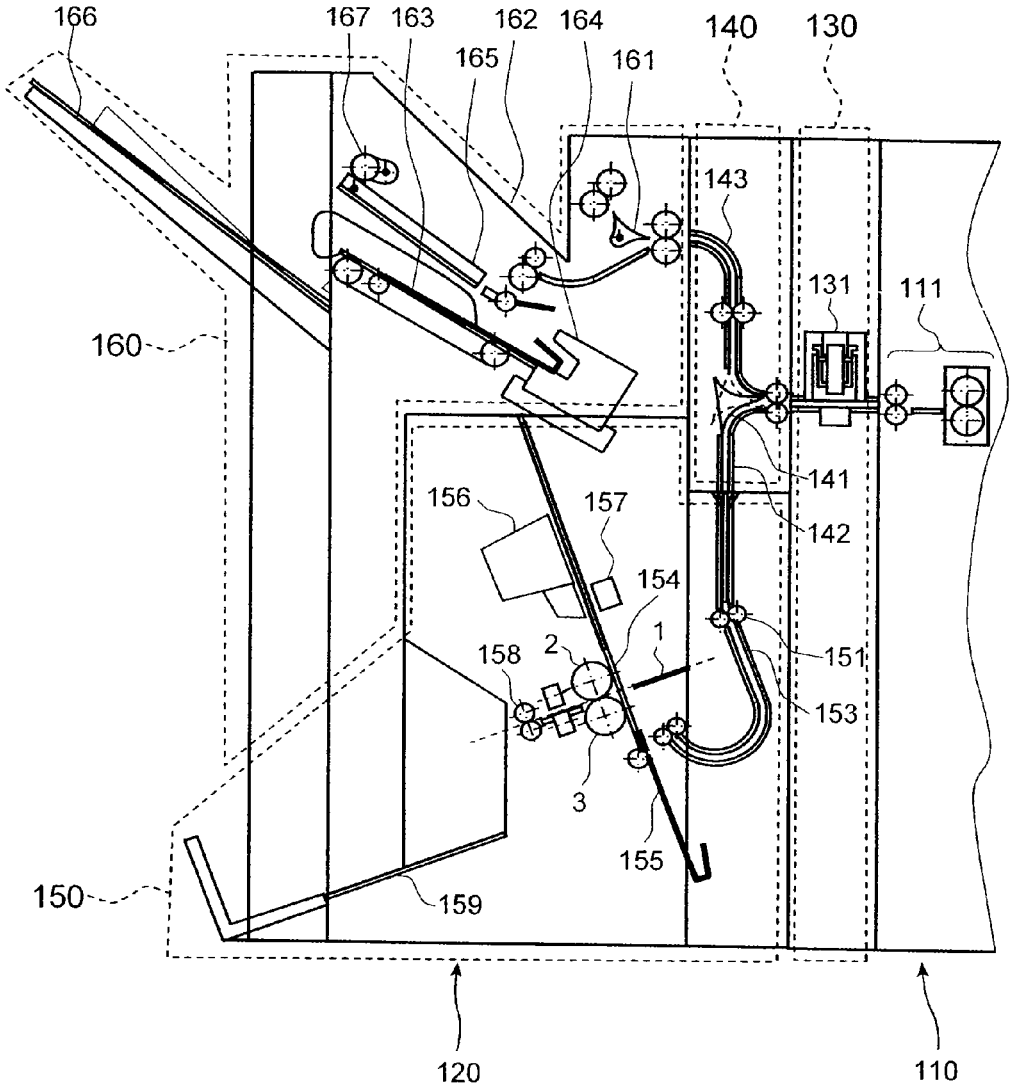
FIG. 2 is a drawing of the image forming apparatus relating to the same embodiment which is partially enlarged.

FIG. 2 is an enlarged view of the neighborhood of the sheet finishing apparatus 120 shown in FIG. 1. The sheet finishing apparatus 120 has a puncher unit 130 for performing the post process such as the punching process, a sheet branching portion 140 for distributing sheets to either of a saddle unit portion 150 and a fisher portion 160, the saddle unit portion 150 for performing the ordinary printing process and the post processes such as sorting of sheets, saddle stitching of sheets, and folding of sheets, and the finisher portion 160 for performing the post processes such as the binding process of the sheet bundle end portion. The sheet finishing apparatus 120 performs the post process for sheets according to an input instruction of the operation panel of the main body 110 of the image forming apparatus by a user or a print instruction of a personal computer connected to the image forming apparatus 100 via a LAN.

Sheets ejected from the sheet ejection portion 111 has a plurality of conveyor rollers are carried into the puncher unit 130 on the downstream side in the sheet conveying direction. The puncher unit 130 has a puncher 131 and performs the post process such as a two-hole punching process for sheets. Further, the puncher unit 130 is one of the optional devices of the sheet finishing apparatus 120, though in this embodiment, it functions as a part of the sheet finishing apparatus 120.

Sheets discharged from the puncher unit 130 are carried into the sheet branching portion 140 on the downstream side in the sheet conveying direction. The sheet branching portion 140 includes a branching member 141 for deflecting the sheet conveying direction, a conveyor path in the saddle unit 142 which is a sheet conveying route to the saddle unit portion 150, and a conveyor path in the finisher 143 which is a sheet conveying route to the finisher portion 160. The branching member 141, according to the sheet post process selected by the aforementioned print instruction by the user, deflects and leads the sheets to either of the directions toward the conveyor path in the saddle unit 142 and the conveyor path in the finisher 143.

The saddle unit portion 150 includes a conveyor path in the binding processor 153 which is extended from the conveyor path in the saddle unit 142 and has conveyor rollers 151 and 152, a sheet take on plate 154 for receiving a sheet bundle discharged from the conveyor roller 152, a sheet elevator 155 for adjusting the sheet position, a saddle stitching mechanism having a stapler 156 and an anvil 157 for performing the saddle stitching process for the sheet bundle, a saddle stitching mechanism having a blade 1 for pressing the sheet bundle and a pair of folding rollers 2 and 3 for folding the sheet bundle, a conveyor roller 158 for discharging the sheet bundle which is folded and bound, and a bundled sheet receiving tray 159 for sequentially receiving bound sheet bundles conveyed from the conveyor roller 158.

Inside the saddle unit portion 150, although the explanation particularly using illustrations and numbers is omitted, in addition to the aforementioned components, various rollers and other devices for operating the aforementioned components or conveying sheets are supported. These devices are driven by the electrical apparatuses such as various motors and solenoids. Further, the electrical apparatuses are controlled by a control system including a microprocessor not drawn.

When the folding process and saddle stitching process are performed, sheets deflected to the conveyor path in the saddle unit 142 by the branching member 141 pass through the conveyor path in the binding processor 153 by the conveyor rollers 151 and are discharged to the sheet take on plate 154 by the conveyor rollers 152. The sheet take on plate 154 is formed at a steep inclination to the installation surface of the sheet finishing apparatus 120. Therefore, the sheets discharged from the conveyor rollers 152 slide down sequentially to the pan portion of the sheet elevator 155 along the sheet elevator 154 and the sheet ends on the side in contact with the pan portion are aligned. The sheet elevator 155 can move up and down along the sheet take on plate 154, thereby can move the sheet bundle to the saddle stitching mechanism and folding mechanism in the state that the sheet ends are aligned by the pad portion.

When sheets of a predetermined number are stored on the pad portion of the sheet elevator 155, the sheet elevator 155 moves up so that the central part of the sheet bundle comes to the binding position of the stapler 156. By the two staplers 156 and anvils 157 arranged this side and on the innermost side of the drawing, the sheet bundle is bound at the two locations in the central part.

Next, the sheet elevator 155 moves down so that the central part of the sheet bundle subjected to the saddle stitching process comes to the position where it faces on the blade 1. The sheet bundle makes contact with the folding rollers 2 and 3 via an opening portion formed in the neighborhood of the blade 1 of the sheet take on plate 154. The center (the binding position) of the sheet bundle is pressed by the blade 1 and is pressed out to the nip portion of the paired folding rollers 2 and 3. The folding rollers 2 and 3 nip the sheet bundle and convey them under pressure, thereby fold the sheet bundle in two at the central part. The detailed operation of the folding mechanism will be explained later. The sheet bundle subjected to the folding process is discharged to the bundled sheets receiving tray 159 by the conveyor roller 158.

When performing only the folding process without performing the saddle stitching process, the sheet elevator 155, after the sheets of the predetermined number are stored on the pad portion, without performing the saddle stitching process, moves up so that the central part of the sheet bundle comes to the position where it faces on the blade 1.

Hereinafter, by referring to FIG. 3, the sheet processing mechanism will be described in detail. Further, the drawing shows a schematic view that only the components necessary to explain a sheet processing apparatus 10 are extracted, and the parts duplicated with the aforementioned components are omitted in illustrations and explanation, and to the same components, the same numerals are assigned.

The sheet processing apparatus 10 includes the blade 1, the paired folding rollers 2 and 3, a spring portion 4 connected to the rotary shaft of the folding rollers 2 for pressing the folding rollers 2 toward the rotary shaft of the folding roller 3, a reciprocable moving member 5 for holding fast the blade 1, paired coil springs 6 which are held on both sides of the blade 1 on the reciprocable moving member 5, and a pair of idle rollers 7 which are positioned the leading edge of the coil springs 6. Between the blade 1 and the folding rollers 2 and 3, a sheet bundle 8 which is not subjected to the saddle stitching process is arranged so that the central part thereof comes to the position where it faces on the blade 1.

In the folding roller 2, the rotary shaft of the folding roller 2 is formed movably so that the inter-shaft distance between the folding rollers 2 and 3 can be shifted and is driven to rotate in the direction of the arrow shown in the drawing. The folding roller 2 is pressed toward the rotary shaft of the folding roller 3 by the spring portion 4, so that the pressurized folding roller 3 rotates in the direction of the arrow shown in the drawing in synchronization with the rotation of the folding roller 2. By doing this, a nip pressure is generated in the nip portion which is a contact part between the folding rollers 2 and 3 and the sheet bundle can be conveyed under pressure.

The reciprocable moving member 5 can carry out a reciprocable movement that it moves from the start position shown in the drawing to the operation position where it approaches the folding roller 2 and the blade 1 held fast by the reciprocable moving member 5 presses out the sheet bundle 8 to the nip portion and returns to the start position shown in the drawing.

In the paired coil springs 6, the respective one ends are held fast by the reciprocable moving member 5 and are arranged on both sides of the blade 1 so as to hold the blade 1 and the respective other ends are opposite to the folding rollers 2 and 3. Namely, as shown in FIG. 3B, a shaft 7*b* is inserted into a cylindrical support portion 5*a* formed so as to project from the moving member 5 with one end thereof movable and the other end of the shaft 7*b* is connected to a rotary shaft 7*a* of the idle roller 7. The coil spring 6, so as to press the idle roller 7 in the left direction of the drawing, is inserted through the support portion 5*a* and shaft 7*b*. Further, the paired coil spring 6 are arranged almost line-symmetrically about the blade 1. Here, the almost line-symmetric arrangement about the blade 1 means that the straight line which is parallel with the direction where the blade 1 moves due to the movement of the reciprocable moving member 5 and passes the center of the blade 1 (the dotted line shown in the drawing) is decided as a line-symmetric axis and the upper and lower arrangement is almost symmetrical about this axis of symmetry.

The paired idle rollers 7 are driven rollers which have no drive device and can rotate freely and are arranged at the aforementioned other ends of the paired coil springs 6, and in the drawing, the upper idle roller 7 responds to the folding roller 2, and the lower idle roller 7 responds to the folding roller 3. The idle rollers 7, similarly to the paired coil springs 6, are arranged almost line-symmetrically about the blade 1. So that the idle rollers 7 make contact with the sheet bundle 8 before the blade 1 due to the movement of the reciprocable moving member 5, the end of the blade 1 making contact with the sheet bundle 8 is structured so as not to jut out on the side of the sheet bundle 8 from the end of the idle roller 7 making contact with the sheet bundle 8.

The sheet processing apparatus 10, although the explanation particularly using illustrations and numerals is omitted, further includes a folding roller drive means to rotate the folding rollers 2 and a reciprocable moving member drive means to permit the reciprocable moving member 5 to make the reciprocable movement. These drive means are driven by the electrical apparatuses such as various rollers, motors, and gears. Further, the electrical apparatuses are controlled by a control system including a microprocessor not drawn. Particularly, the operation timing of the electrical apparatuses are controlled variously by the software of the control system according to the sheet kind and the number of sheets.

Next, by referring to FIGS. 4 to 7, the operation of the sheet processing apparatus 10 will be explained.

Figure 4:
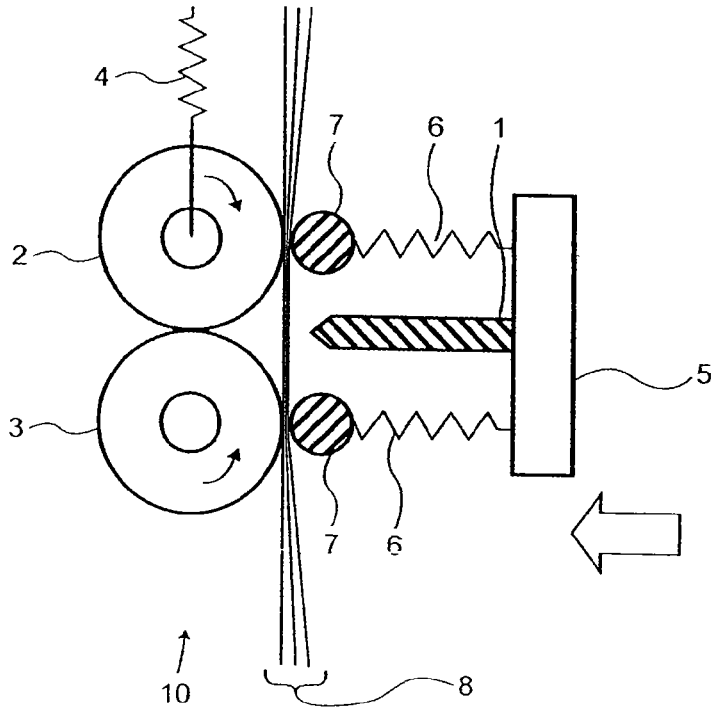
FIG. 4 is a cross sectional view for explaining the operation of the image forming apparatus relating to the same embodiment.

FIG. 4 shows the condition that the reciprocable moving member 5 moves in the direction of the void arrow shown in the drawing, and the idle rollers 7 make contact with the sheet bundle 8 and press the sheet bundle 8 to the folding rollers 2 and 3. The drawing, although the blade 1 is not in contact with the sheet bundle 8, shows the condition immediately before contact. The sheet bundle 8 is held between the folding rollers 2 and 3 and the idle rollers 7 and the sheet interval of each sheet between the two idle rollers 7 is narrowed. Further, in this embodiment, as mentioned above, the idle rollers 7 make contact with the sheet bundle 8 before the blade 1 and press the sheet bundle 8 against the folding rollers 2 and 3, though a constitution that the idle rollers 7 and the blade 1 make contact with the sheet bundle 8 almost similarly may be used.

Figure 5:
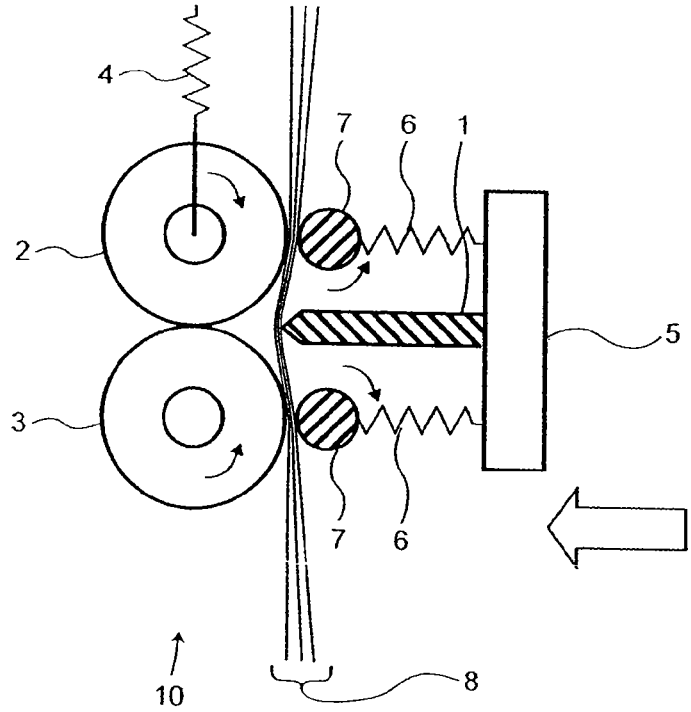
FIG. 5 is a cross sectional view for explaining the operation of the image forming apparatus relating to the same embodiment.

FIG. 5 shows the condition that the reciprocable moving member 5 further moves in the direction of the void arrow and the blade 1 presses the central part of the sheet bundle 8. The coil springs 6 are pressed by the reciprocable moving member 5, so that the elasticity due to the recovery force is increased and further presses the sheet bundle 8 toward the rotary shafts of the folding rollers 2 and 3 via the idle rollers 7. The sheet bundle 8 is pressed by the end of the blade 1 and forms a bent portion at the central part thereof. Further, the sheet bundle 8 is pressed against the folding rollers 2 and 3 by the idle rollers 7 and is conveyed toward the nip portion due to the friction with the contact surface with the folding rollers 2 and 3. The idle rollers 7 press and hold the sheet bundle 8 in contact and rotate in the direction of the arrow shown in the drawing in synchronization with the conveyance of the sheet bundle 8. The rotational speed of the folding rollers 2 and 3 and the moving speed of the reciprocable moving member 5 are controlled so that the bent portion formed by conveying the sheet bundle 8 by the folding rollers 2 and 3 and the bent portion formed by pressing the sheet bundle 8 by the blade 1 coincide with each other.

Figure 6:
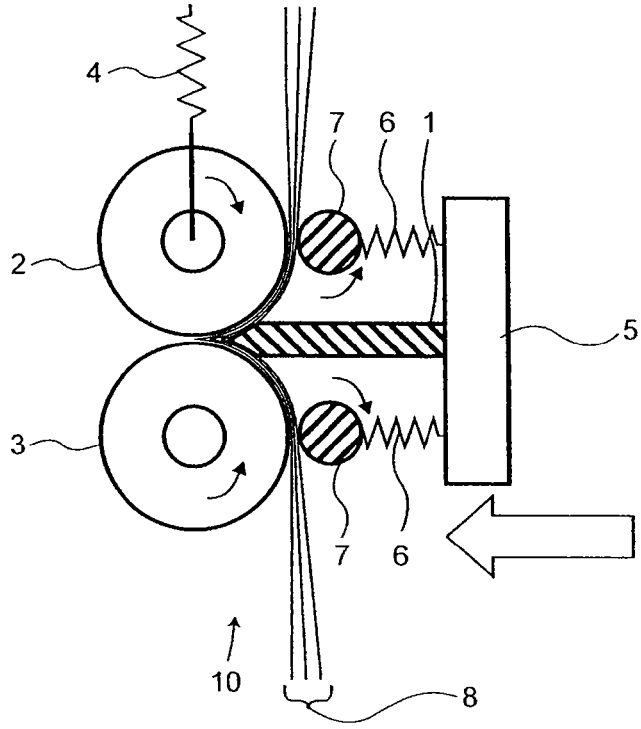
FIG. 6 is a cross sectional view for explaining the operation of the image forming apparatus relating to the same embodiment.

FIG. 6 shows the condition that the reciprocable moving member 5 moves more in the direction of the void arrow than the condition shown in FIG. 5, and the blade 1 presses the central part of the sheet bundle 8 to the nip portion of the folding rollers 2 and 3, and the folding rollers 2 and 3 hold the bent portion of the sheet bundle 8. The coil springs 6 are contracted more than the condition shown in FIG. 5, so that the force of the idle rollers 7 for pressing the sheet bundle 8 is increased more.

Figure 3A:
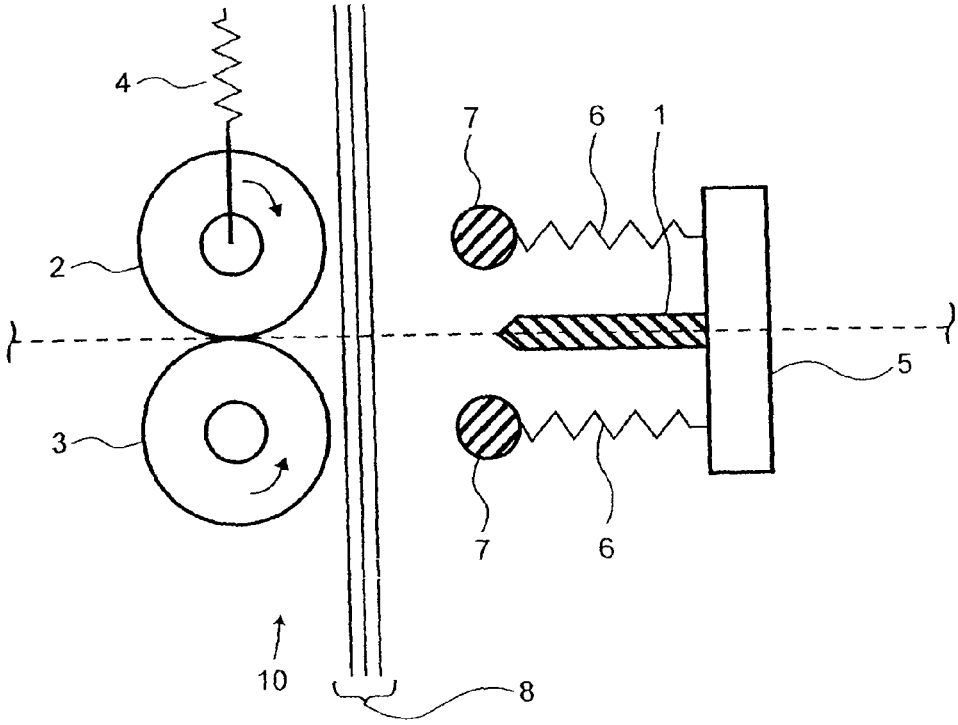
FIG. 3A is a cross sectional view showing the schematic constitution of the image forming apparatus relating to the same embodiment.
Figure 3B:
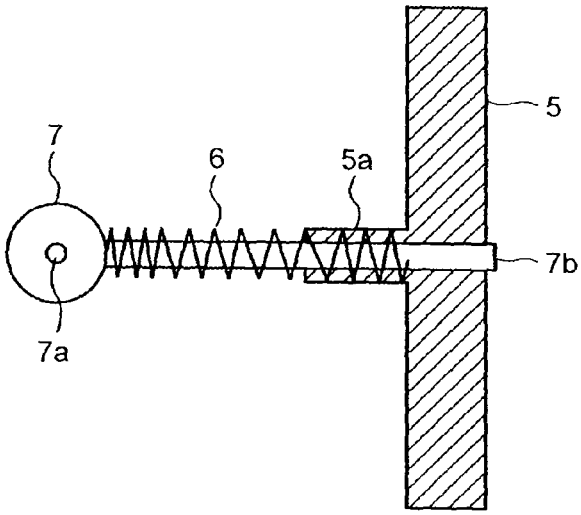
FIG. 3B is a cross sectional view showing particularly the coil spring attaching structure of the image forming apparatus relating to the same embodiment.
Figure 7:
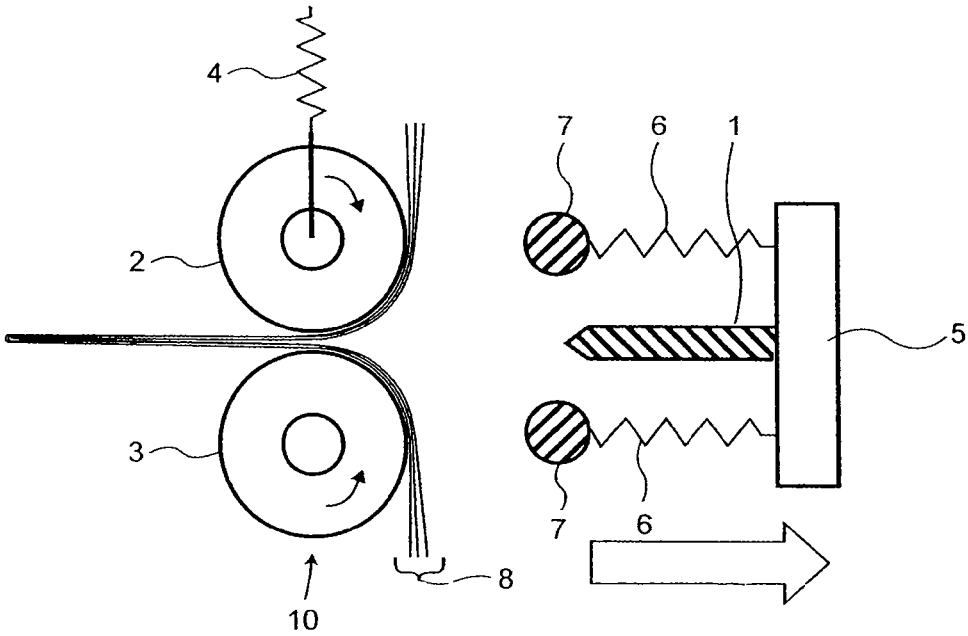
FIG. 7 is a cross sectional view for explaining the operation of the image forming apparatus relating to the same embodiment.

FIG. 7 shows the condition that the reciprocable moving member 5 moves in the direction of the void arrow and returns to the start position shown in FIG. 3. In FIG. 6, the bent portion of the sheet bundle 8 held by the nip portion is conveyed under pressure by the nip pressure of the folding rollers 2 and 3 caused by the elastic force of the spring portion 4, is given a fold, and passes the nip portion. The residual part of the sheet bundle 8 is conveyed similarly to the nip portion by the folding rollers 2 and 3.

Further, in this embodiment, as shown in the drawing, the constitution that the sheet bundle is given a fold and then in the state that the residual part of the sheet bundle 8 is still conveyed by the folding rollers 2 and 3, the reciprocable moving member 5 returns to the start position is adopted, though a constitution that the sheet bundle 8 is all pressed and conveyed by the folding rollers 2 and 3 and idle rollers 7 and then the reciprocable moving member 5 returns to the start position may be adopted.

On the other hand, by referring to FIG. 2, the finisher portion 160 will be explained.

The finisher portion 160 includes a branching member 161 for switching the conveyor path according to the selected post process, a receiving tray 162 for sequentially receiving ordinary print sheets, a processing tray 163 for loading a sheet bundle to be subject to the binding process, a stapler 164 for binding a sheet bundle, an intermediate queuing tray 165 for temporarily collecting sheets conveyed in order to ensure the time necessary for the binding process and sheet conveyance, and a receiving tray 166 for receiving a bound or sorted sheet bundle. Sheets carried in from the conveyor path in the finisher 143 are deflected and led to either of the two upper and lower directions by the branching member 161.

The finisher portion 160, although the explanation using illustrations and numerals is omitted, further includes various conveying rollers and other devices for making contact with sheets or conveying sheets. These devices are driven by the electrical apparatuses such as various motors and solenoids. Further, the electrical apparatuses are controlled by a control system including a microprocessor not drawn.

In the case of the ordinary print for performing no particular post process other than the process by the puncher unit 130, sheets are deflected in the conveyor path by the branching member 141 and are led to the conveyor path in the finisher 143. Then, the sheets are deflected to the upper direction by the branching member 161 and are discharged to the receiving tray 162 by the conveyor rollers.

Further, when performing the binding process of the end portion of a sheet bundle and the sorting process when printing copies without performing the saddle stitching process and folding process, the sheets are led to the conveyor path in the finisher 143 by the branching member 161. Then, the sheets are deflected to the lower direction by the branching member 161 and are discharged to the intermediate queuing tray 165 by the conveyor rollers.

The intermediate queuing tray 165 has a pair of intermediate queuing tray components (not drawn) capable of moving right and left. The intermediate queuing tray 165 receives sheets when the queuing tray components are closed. The intermediate queuing tray 165 stores temporarily sheets sequentially conveyed, thereby adjusts the conveying flow of the sheets, ensures the time necessary for sheet conveyance executed on the downstream side of the sheet conveyor path and binding of the end portion of a sheet bundle which will be described later, thus makes the sheet post process smooth. Further, a roller on the intermediate queuing tray 167 is used to align the sheets stored in the intermediate queuing tray 165.

When sheets of a predetermined number are stored in the intermediate queuing tray 165, the intermediate queuing tray components are opened and the sheet bundle slides down to the processing tray 163 by its own weight. The sheet bundle is subject to the aligning process of aligning the longitudinal and transverse end portions by an aligning member (not drawn) on the processing tray 163.

When binding the sheet bundle, if sheets of the predetermined number are aligned and stored on the processing tray 163, the binding process is performed by the stapler 164. The sheet bundle subjected to the binding process by the stapler 164 is discharged and received by the receiving tray 166.

When performing only the sorting process, the sheet bundle conveyed and aligned by the processing tray 163 is not subject to the binding process by the stapler 164 but is conveyed and received by the receiving tray 166.

Further, in this embodiment, the blade 1 is a "pushing member", and the folding roller 2 is a "first roller", and the folding roller 3 is a "second roller", and the reciprocable moving member 5 is a "moving member", and the paired coil springs 6 are "paired elastic members", and the idle rollers 7 are "third and fourth rollers", and the sheet bundle 8 is "sheets", though these are respectively just an example. Further, the position of the reciprocable moving member 5 shown in FIG. 3 is a "start position" and the positions of the reciprocable moving member 5 shown in FIGS. 4 to 6 are "operation positions" and these are respectively just an example.

As described above, according to the sheet processing apparatus relating to this embodiment, the following effects can be obtained.

<1> Immediately before pressing the sheet bundle 8 by the blade 1 under the folding process, the two idle rollers 7 arranged on both sides of the blade 1 press the sheet bundle 8 to the folding rollers, thus the inter-sheet interval of the sheet bundle 8 is reduced and each inter-sheet contact area can be ensured. By doing this, the frictional force between the sheets can be improved, so that the adhesion of the sheet bundle 8 is strengthened and furthermore, the sheet bundle can be prevented from being shifted and folded.

<26> When the paired idle rollers 7 under the folding process respectively press the sheet bundle 8 to the folding rollers 2 and 3, since the two idle rollers 7 are arranged almost line-symmetrically about the blade 1, each sheet composing the sheet bundle 8 can increase the contact area symmetrically about the central part of the sheet bundle 8 pressed by the blade 1. Therefore, the frictional force due to the contact surface is increased symmetrically and evenly about the central part of the sheet bundle 8 and the conveyance shift of the sheets due to variations in the force applied to the sheet bundle 8 can be suppressed, thus the bookbinding quality can be improved.

<3> While pressing the sheet bundle 8 by the blade 1 under the folding process, the sheet bundle 8 is conveyed by pressed and held by the folding rollers 2 and 3 and the idle rollers 7 and the friction with the contact surface between the sheets can be ensured, so that a shift such as sliding down of the sheet of the sheet bundle 8 in contact with the blade 1 by its own weight from the end of the blade 1 can be suppressed from an occurrence. Therefore, the sheet bundle 8 can be subject to the folding process with the end portion thereof aligned, thus the bookbinding quality can be improved.

<4> The idle rollers 7 press the sheet bundle in synchronization with the conveyance of the sheet bundle 8, so that the sheet bundle 8 can be pressed and conveyed without scratching the surface of the sheet bundle 8.

<5> As the reciprocable moving member 5 approaches the nip portion, the sheet bundle 8 projected by the blade 1 is deformed and the possibility of damage of the alignment of the sheet bundle is increased, though as the reciprocable moving member 5 approaches the nip portion, the force for pressing the sheet bundle 8 by the idle rollers 7 is increased, so that the alignment of the sheet bundle can be ensured and the bookbinding quality can be improved.

<6> When the blade 1 under the folding process presses the central part of the sheet bundle 8 to the nip portion of the folding rollers 2 and 3 and the folding rollers 2 and 3 hold the bent portion of the sheet bundle 8, at the three points of the blade 1 and the two idle rollers 7 arranged almost line-symmetrically about the blade 1, the sheet bundle 8 is pressed to the folding rollers 2 and 3. Therefore, the rotational power of the folding rollers 2 and 3 can be transferred to the sheet bundle 8 efficiently and evenly to the central part of the sheet bundle 8, and the sheet shift during the folding process is suppressed, and the bookbinding quality can be improved.

Second Embodiment

Next, the second embodiment of the sheet processing apparatus will be explained. In the sheet processing apparatus relating to this embodiment, the basic structure thereof is based on that of the sheet processing apparatus 10 of the first embodiment. However, in the sheet processing apparatus relating to this embodiment, it is different that the position for pressing the sheet bundle by the idle rollers is limited. Such a sheet processing apparatus will be explained by referring to FIGS. 8 and 9. Further, for the structure based on the first embodiment, the same numerals are assigned and the detailed explanation thereof will be omitted.

Figure 8:
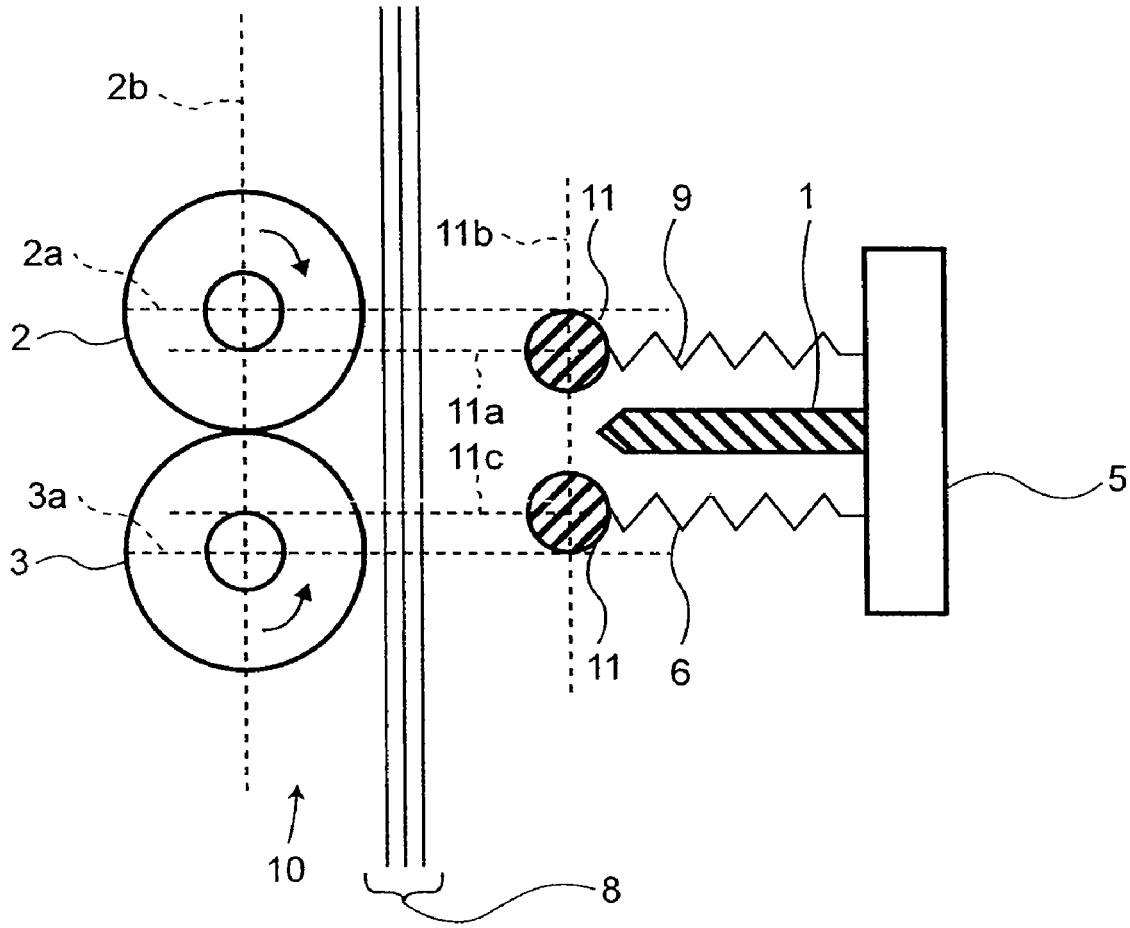
FIG. 8 is a cross sectional view showing the schematic constitution of the image forming apparatus relating to the second embodiment of the present invention.

FIG. 8 is a cross sectional view showing the schematic constitution of a sheet processing apparatus 20. The points where the straight lines parallel with the movement direction of the reciprocable moving member 5 and the straight lines orthogonal to the straight lines cross indicate the rotary shafts of the folding rollers 2 and 3 and the idle rollers 11. The rotary shafts of the folding rollers 2 and 3, that is, the points where the paired straight lines cross are indicated by straight lines 2*a* and 2*b* and straight lines 3*a* and 2*b*. The rotary shafts of the two idle rollers 11, that is, the points where the paired straight lines cross are indicated by straight lines 11*a* and 11*b* and straight lines 11*c* and 11*b*. As indicated by the relationship between the straight lines 2*a* and 3*a* and between the straight lines 11*a* and 11*c*, the idle roller 11 opposite to the folding roller 2 is arranged so that the rotary shaft thereof is located inside the rotary shaft of the folding roller 2 (on the nip side of the folding rollers 2 and 3). Further, the idle roller 11 opposite to the folding roller 3 is arranged so that the rotary shaft thereof is located inside the rotary shaft of the folding roller 3. Coil springs 9 having the idle rollers 11 at the ends thereof are held fast by the reciprocable moving member 5 in the neighborhood of the blade 1 according to the arrangement of the idle rollers 11.

Figure 9A:
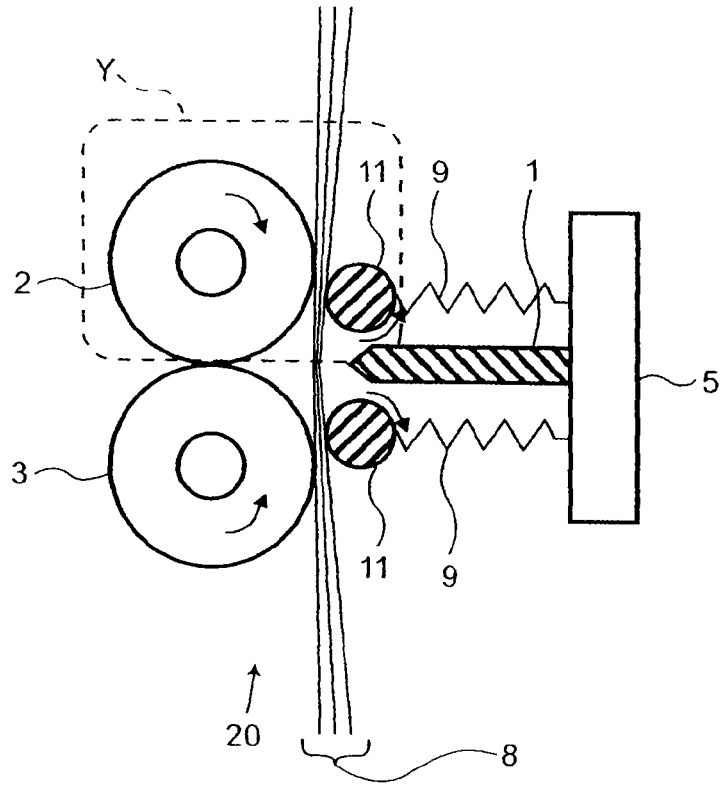
FIGS. 9A and 9B are cross sectional views for explaining the operation of the image forming apparatus relating to the same embodiment.
Figure 9B:
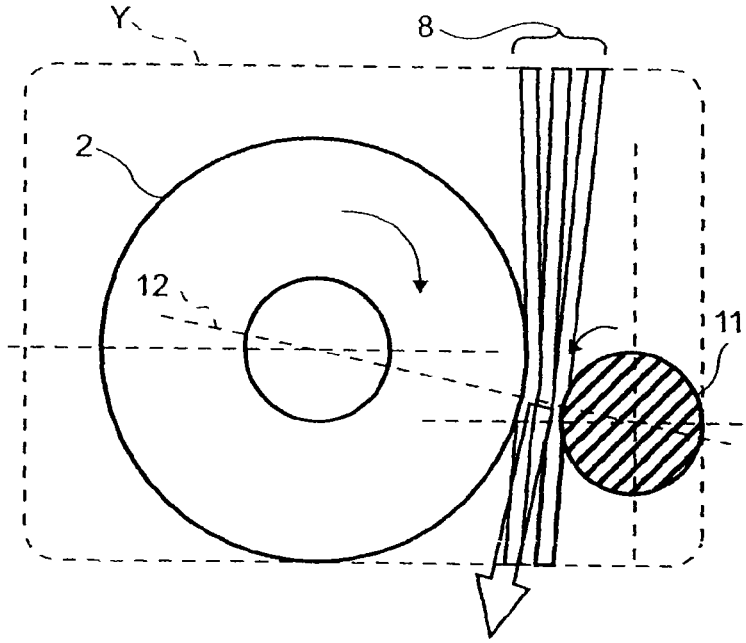

FIG. 9 is a cross sectional view showing the operation of the image forming apparatus 20 and shows the condition that the idle rollers 11 press the sheet bundle 8 to the folding rollers 2 and 3. From FIG. 4 used to explain the first embodiment, the position where the idle rollers press the sheet bundle is different. FIG. 9B is an enlarged view of the portion Y shown in FIG. 9A. The rotary shafts of the folding roller 2 and the idle roller 11 are indicated by the straight lines parallel with the movement direction of the reciprocable moving member 5 and the straight lines orthogonal to the straight lines and a straight line 12 passing the rotary shaft of the folding roller 2 and the rotary shaft of the idle roller 11 is indicated. When the idle roller 11 presses the sheet bundle 8 to the folding roller 2, the pressure of the idle roller 11 is directed to the rotary shaft of the folding roller 2, so that the idle roller 11 presses the sheet bundle 8 in parallel with the straight line 12. Therefore, the drive rotational power of the folding roller 2 and the driven rotational power of the idle roller 11 function as force for conveying the sheet bundle 8 in the direction of the void arrow shown in the drawing. Namely, the conveyance under pressure of the sheet bundle 8 by the folding rollers 2 and 3 and the idle rollers 11 permits the sheet bundle 8 to form a bent portion which is convex toward the nip portion of the folding rollers 2 and 3.

Figure 10:
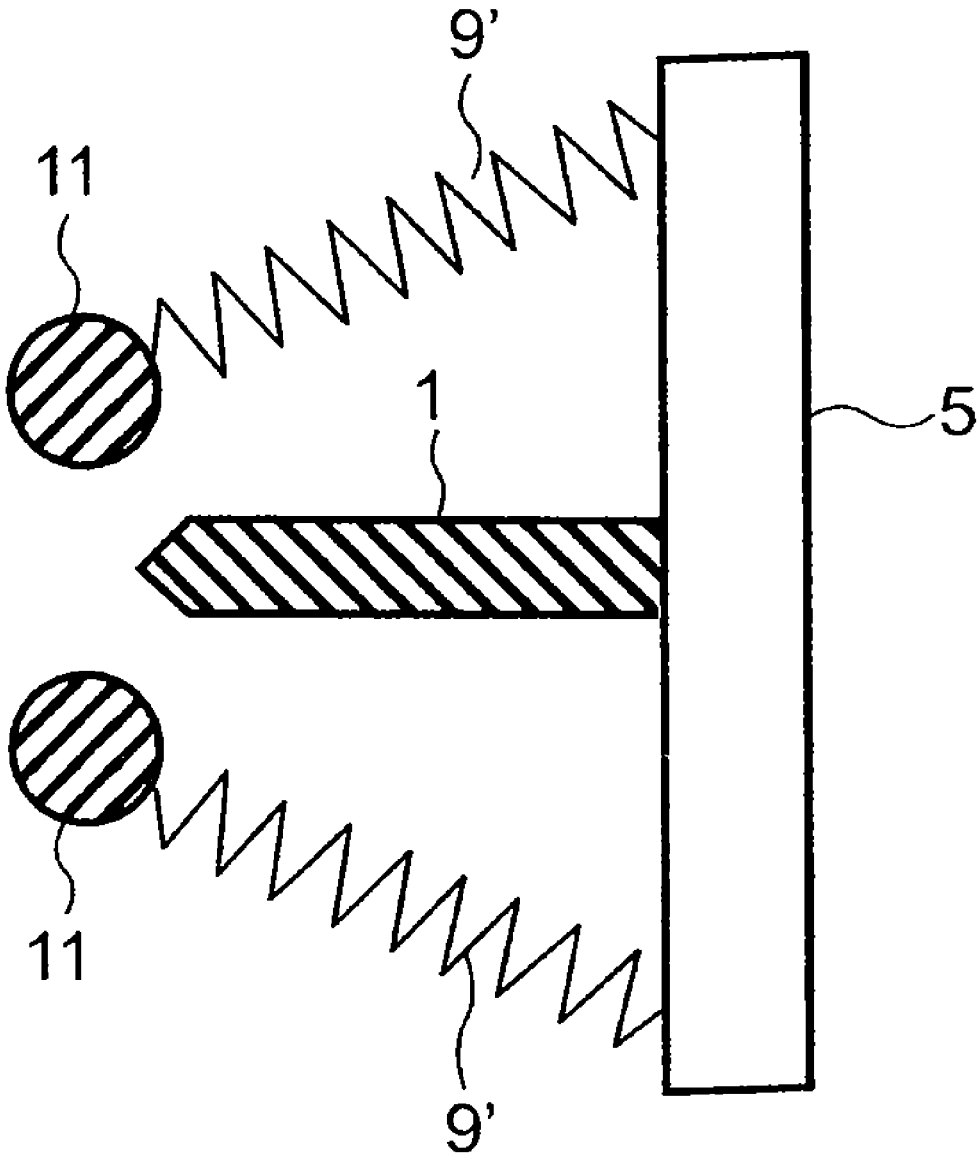
FIG. 10 is a cross sectional view showing another embodiment of the coil spring attaching structure.

The coil springs 9 are not limited to ones arranged in parallel with the movement direction of the reciprocable moving member 5. The rotary shafts of the idle rollers 11 are preferably arranged inside the rotary shafts of the folding rollers 2 and 3. Therefore, as shown in FIG. 10, coil springs 9' may be arranged so as to separate gradually from the blade 1 along the side of the reciprocable moving member 5 from the side of the idle rollers 11.

Further, in this embodiment, the coil spring 9 are "elastic members", and the idle rollers 11 are "third and fourth rollers", and the straight lines 11*a* and 11*b* are "straight lines extending from the rotary shafts of the third and fourth rollers in parallel with the movement direction of the moving member" and these are respectively just an example.

As described above, according to the sheet processing apparatus relating to this embodiment, the following effects can be obtained.

<7> When the idle rollers 11 under the folding process press the sheet bundle 8 to the folding rollers 2 and 3, the conveyance under pressure of the sheet bundle 8 by the folding rollers 2 and 3 and the idle rollers 11 permits the sheet bundle 8 to form a bent portion which is convex toward the nip portion of the folding rollers 2 and 3. Therefore, the formation of the bent portion formed by pressing the sheet bundle 8 by the blade 1 is complemented, and the application of useless force to the bent portion can be suppressed, so that sheets can be prevented from shifted and folded, thus the bookbinding quality can be improved.

Third Embodiment

Next, the third embodiment in which the sheet processing apparatus is realized will be explained. In the sheet processing apparatus relating to this embodiment, the basic structure thereof is based on those of the sheet processing apparatuses 10 and 20 of the first and second embodiments. However, in the sheet processing apparatus relating to this embodiment, it is different that the position of the reciprocable moving member at the operation position where the sheet bundle is pressed into the nip portion of the folding rollers by the blade is limited. Such a sheet processing apparatus will be explained by referring to FIGS. 10 and 11. Further, for the structure based on the first and second embodiments, the same numerals are assigned and the detailed explanation will be omitted.

Figure 11:
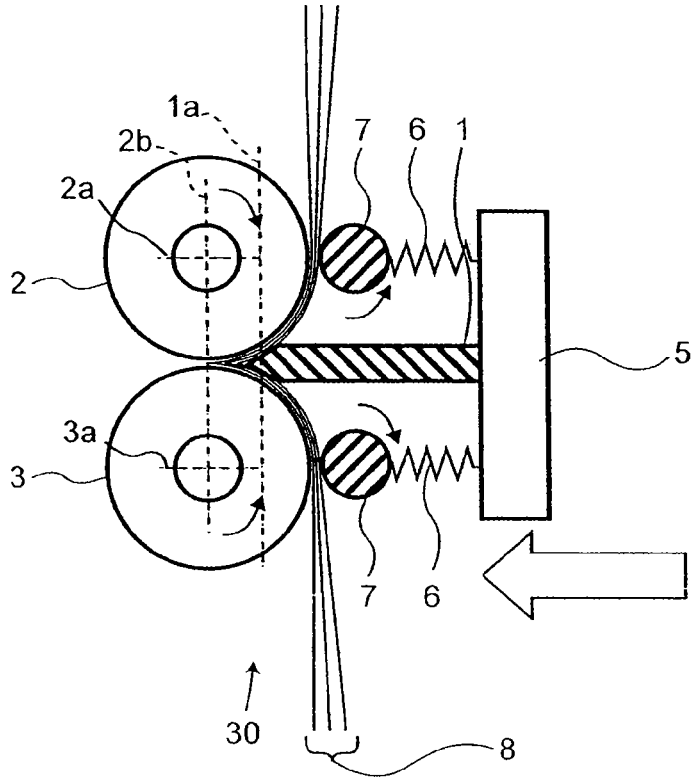
FIG. 11 is a cross sectional view for explaining the operation of the image forming apparatus relating to the third embodiment.
Figure 12:
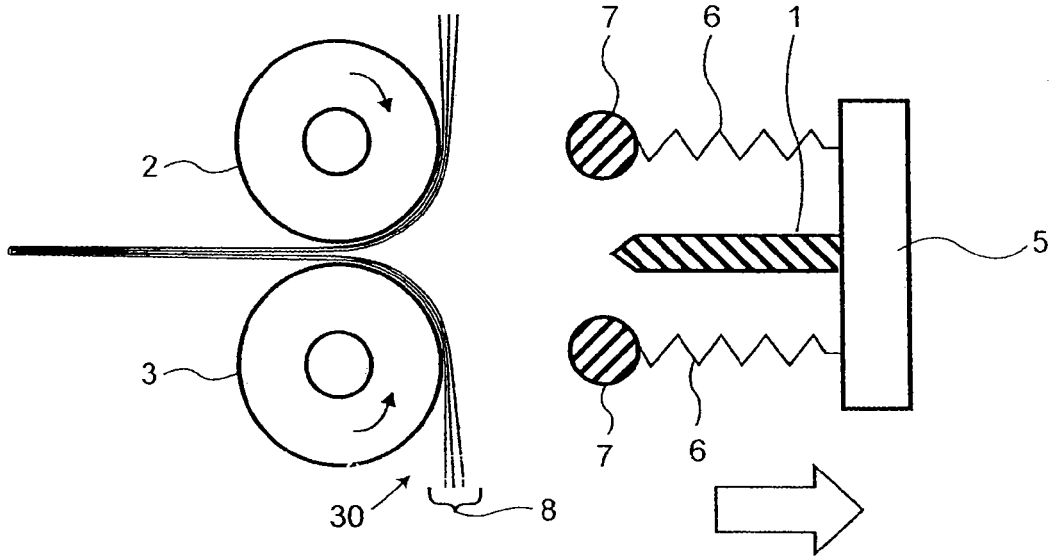
FIG. 12 is a cross sectional view for explaining the operation of the image forming apparatus relating to the same embodiment.

FIG. 11 is a cross sectional view showing the schematic constitution of a sheet processing apparatus 30. The drawing shows the operation position where a reciprocable moving member 12 approaches most the folding rollers 2 and 3 and shows the condition that the blade 1 presses the sheet bundle 8 into the nip portion of the folding rollers 2 and 3. By the straight line 2*b* passing the rotary shafts of the folding rollers 2 and 3 and the straight lines 2*a* and 3*a* orthogonal to the straight line, the rotary shafts of the folding rollers 2 and 3 are indicated. The parts where the straight line 2*b* crosses the outer peripheral circles of the folding rollers 2 and 3 are the nip portion of the folding rollers 2 and 3. As shown by the relationship between a straight line 1*a* passing the top of the leading edge of the blade 1 which is parallel with the straight line 2*b* and the straight line 2*b*, the leading edge of the blade 1 pressing the sheet bundle 8 into the nip portion does not enter the nip portion. The reciprocable moving member 12 for holding fast the blade 1 comes to the operation position shown in the drawing and presses the sheet bundle 8 into the nip portion, and then as shown in FIG. 12, returns to the original start position. During the period, the folding rollers 2 and 3 add a fold to the sheet bundle 8 by the nip pressure of the nip portion and performs the folding process.

Further, in this embodiment, for convenience, the nip portion is decided as the point of contact of the outer peripheral circle of the folding roller 2 with the outer peripheral circle of the folding roller 3, though the folding roller 2 and folding roller 3 are pressurized each other, thus when the outer peripheral circles of the folding rollers are deformed and a contact part having an area is formed, the contact part having the area is taken as a nip portion.

Further, in this embodiment, the blade 1 is controlled so as not to enter the nip portion, though the present invention is not limited to it. For example, the length of the blade 1 may be adjusted to a length that even when the reciprocable moving member 12 approaches most the folding rollers 2 and 3, the blade 1 does not enter the nip portion.

Further, in this embodiment, the idle rollers 7 are "driven rollers" of the present invention and the parts where the straight line 2*b* crosses the outer peripheral circles of the folding rollers 2 and 3 are a "nip portion" of the present invention, though these are respectively just an example.

As described above, according to the sheet processing apparatus relating to this embodiment, the following effects can be obtained.

<8> When pressing the sheet bundle 8 into the nip portion by the blade 1 under the folding operation, if the blade 1 enters the nip portion, problems arise that the blade 1 cannot be pulled out from the nip portion and a sufficient fold cannot be added and even if the blade 1 can be pulled out from the nip portion, the friction with the contact surface of a sheet in contact with the blade 1 is applied in the opposite direction to the sheet pressing direction, thus the sheet surface in contact is scratched or the concerned sheet moves in the opposite direction to the pressing direction. However, in this embodiment, the blade 1 does not enter the nip portion, thus the aforementioned problems can be avoided and the bookbinding quality can be ensured.

<9> The effects described in <1> to <8> can be realized by controlling the reciprocating movement of the reciprocable moving member 5 for holding fast the blade 1 and the two idle rollers 7, so that the controller can be simplified.

Other Embodiments

This sheet processing apparatus is not limited to the structures indicated as the aforementioned embodiments and for example, the following embodiments obtained by properly modifying the aforementioned embodiments within a range which is not deviated from the objects of the present invention can be executed.

<a> The present invention is not limited to a constitution that in the reciprocable moving member realized as a "moving member", the blade realized as a "pushing member" and the coil springs realized as "elastic members" are installed. No reciprocable moving member is installed and the blade and coil springs may be controlled integrally in movement.

<b> The "sheet processing apparatus" is not limited to a folding apparatus for folding the central part of a sheet bundle in two. The folding position of a sheet bundle and the number of folds are not restricted. For example, Z folding is acceptable.

<c> The "third and fourth rollers" are not limited to a driven roller for rotating in synchronization with the movement of a sheet bundle in contact. For example, the same drive device as the folding roller may rotate the third and fourth rollers. The third and fourth rollers may follow the conveyance of the sheet bundle.

<d> The "first roller" and "second roller" are not limited to a constitution that the driving folding roller 2 having a spring portion presses the rotary shaft of the driven folding roller 3 to generate a nip pressure. A nip pressure may be generated by a pair of folding rollers. For example, a spring portion is installed on the folding roller 3 which is a driven roller and may be pressurized against the folding roller 2 which is a driving roller. Both folding rollers 2 and 3 may be a drive roller. Both folding rollers 2 and 3 may have a spring portion for pressing each other.

<e> The "elastic member" is not limited to a coil spring. The "elastic member" may be an elastic member for fulfilling the recovery force and pressing a sheet bundle to the folding roller. For example, the "elastic member" may be a plate spring.

<f>"Sheets" are not limited to a sheet bundle composed of a plurality of sheets. "Sheets" may be one sheet.

What is claimed is:

1. A sheet processing apparatus comprising:

a first roller;

a second roller configured to press the first roller to form a nip portion;

a moving member opposite to the nip portion to move from a start position to an operation position approaching the nip portion;

a pushing member supported on the moving member to press a sheet by an end thereof by movement of the moving member and push the sheet into the nip portion; and a third and fourth rollers positioned on both sides of the pushing member and supported on the moving member, the third and fourth rollers projecting from the moving member a distance greater than a distance of a leading end of the pushing member such that the third and fourth rollers make contact with the sheet prior to or at the same time the end of the pushing member makes contact with the sheet when the moving member moves from the start position to the operation position.

2. The apparatus according to claim 1, wherein the third and fourth rollers are supported on the moving member via a pair of elastic members.

3. The apparatus according to claim 2, wherein by movement of the moving member, the third and fourth rollers permit the sheet to respectively make contact with the first and second rollers and to be pressed by elasticity of the elastic members.

4. The apparatus according to claim 1, wherein a straight line passing rotary shafts of the third and fourth rollers and parallel with a movement direction of the moving member is located on the side of the nip portion from a straight line passing rotary shafts of the first and second rollers and parallel with the movement direction of the moving member.

5. The apparatus according to claim 1, wherein the pushing member, at the point of time when the sheet starts to be pushed to the nip portion, moves in a direction separating from the sheet.

6. The apparatus according to claim 1, wherein the third and fourth rollers are driven rollers following movement of the sheet.

7. The apparatus according to claim 2, wherein the elastic members are coil springs.

8. The apparatus according to claim 1, wherein the third and fourth rollers are positioned at line-symmetric about the pushing member.

9. The apparatus according to claim 2, wherein the pair of elastic members are positioned at line-symmetric about the pushing member.

10. The apparatus according to claim 1, further comprising:

a main body;

a sheet storage portion in the main body to store the sheet;

an image forming portion configured to form an image on the sheets; and a discharge portion to convey the sheets with the image formed toward the first and second rollers.

11. The apparatus according to claim 1, further comprising:

a saddle stitching apparatus configured to saddle-stitch the sheet with an image formed.

12. The apparatus according to claim 11, further comprising:

a single stitching apparatus configured to perform a binding process for an end portion of the sheet with an image formed.

13. The apparatus according to claim 12, further comprising:

a branching member to branch the sheet with the image formed to either of the saddle stitching apparatus and the single stitching apparatus.

14. The apparatus according to claim 1, further comprising:

a puncher unit configured to perform a punching process for the sheet with an image formed.

15. A sheet processing apparatus comprising:

first rotating means;

second rotating means for pressuring the first rotating means and forming a nip portion;

moving means opposite to the nip portion for moving from a start position to an operation position for approaching the nip portion;

pushing means supported on the moving means for pressing a sheet by an end thereof by movement of the moving means and pushing the sheet into the nip portion; and third and fourth rotating means positioned on both sides of the pushing means and supported on the moving means, the third and fourth rotating means projecting from the moving means a distance greater than a distance of a leading end of the pushing means such that the third and fourth rotating means making contact with the sheet prior to or at the same time the end of the pushing means makes contact with the sheet when the moving means moves from the start position to the operation position.

16. The apparatus according to claim 15, wherein the third and fourth roller means are supported on the moving means via a pair of elastic means.

17. The apparatus according to claim 16, wherein by movement of the moving means, the third and fourth roller means permit the sheet to respectively make contact with the first and second roller means and to be pressed by elasticity of the elastic means.

18. A sheet processing method comprising:

arranging a sheet between a first roller and a second roller having a nip portion and a pushing member;

moving a moving member holding a first end of the pushing member to an operation position such that a second end of the pushing member approaches the first roller and the second roller;

moving third and fourth rollers positioned on both sides of the pushing member to make contact with the sheet;

pressing the sheet against the first and second rollers by the third and fourth rollers; and pressing a central part of the sheets and pushing the sheets into the nip portion by the second end of the pushing member after or at the same time the third and fourth rollers press the sheet.

19. The method according to claim 18, wherein a pressure to the first and second rollers is caused by an elastic force of a pair of elastic members between the third and fourth rollers and the moving member.

* * * * *